US008746209B2

(12) United States Patent
Shimada et al.

(10) Patent No.: US 8,746,209 B2
(45) Date of Patent: Jun. 10, 2014

(54) THROTTLE APPARATUS FOR INTERNAL COMBUSTION ENGINE

(75) Inventors: Hiroki Shimada, Anjo (JP); Atsushi Tanaka, Anjo (JP); Hideki Asano, Tokai (JP)

(73) Assignees: Denso Corporation, Kariya (JP); Aisan Kogyo Kabushiki Kaisha, Obu (JP)

( * ) Notice: Subject to any disclaimer, the term of this patent is extended or adjusted under 35 U.S.C. 154(b) by 586 days.

(21) Appl. No.: 13/111,152

(22) Filed: May 19, 2011

(65) Prior Publication Data

US 2011/0283970 A1 Nov. 24, 2011

(30) Foreign Application Priority Data

May 19, 2010 (JP) ..... 2010-115367

(51) Int. Cl.

*F02D 11/10* (2006.01)
*F02D 9/02* (2006.01)
*F02D 9/10* (2006.01)

(52) U.S. Cl.

CPC ..... *F02D 11/10* (2013.01); *F02D 2009/0298* (2013.01); *F02D 2009/0277* (2013.01); *F02D 9/1035* (2013.01)

USPC ..... 123/337; 123/399; 123/396

(58) Field of Classification Search

CPC ..... F02D 9/1065; F02D 11/10; F02D 9/02; F02D 2009/0259; F02D 2009/0261; F02D 2009/0262; F02D 2009/0264; F02D 2009/0269; F02D 2009/0271; F02D 2009/0289; F02D 2009/0296; F02D 2009/0298; F02D 2009/0294; F02D 9/1035

USPC ..... 123/337, 404, 399, 396, 361; 251/129.11, 248; 73/114.36, 114.37; 137/554

See application file for complete search history.

(56) References Cited

U.S. PATENT DOCUMENTS

| | | | | | |
|---|---|---|---|---|---|
| 5,018,496 | A | * | 5/1991 | Buchl | 123/399 |
| 5,490,487 | A | * | 2/1996 | Kato et al. | 123/399 |
| 5,524,589 | A | * | 6/1996 | Kikkawa et al. | 123/396 |
| 5,752,484 | A | * | 5/1998 | Apel et al. | 123/396 |
| 5,975,051 | A | * | 11/1999 | Yamada et al. | 123/396 |
| 5,983,858 | A | * | 11/1999 | Hashimoto et al. | 123/396 |
| 6,039,027 | A | * | 3/2000 | Sato et al. | 123/399 |
| 6,047,680 | A | * | 4/2000 | Shimura et al. | 123/399 |
| 6,067,958 | A | * | 5/2000 | Kamimura et al. | 123/337 |
| 6,070,852 | A | * | 6/2000 | McDonnell et al. | 251/129.11 |
| 6,079,390 | A | * | 6/2000 | Hashimoto et al. | 123/399 |
| 6,095,488 | A | * | 8/2000 | Semeyn et al. | 251/129.12 |

(Continued)

FOREIGN PATENT DOCUMENTS

| | | |
|---|---|---|
| JP | 2001-280188 | 10/2001 |
| JP | 2009-185679 | 8/2009 |

*Primary Examiner* — Stephen K Cronin
*Assistant Examiner* — Raza Najmuddin
(74) *Attorney, Agent, or Firm* — Nixon & Vanderhye P.C.

(57) ABSTRACT

A full close position limiting member is adapted to be engaged with a valve gear when a valve is driven in a valve closing direction and reaches a full close position of the valve. An intermediate position limiting member is adapted to be engaged with a return spring when the valve is placed on a side of a predetermined intermediate position where a full close position of the valve is located. The intermediate position limiting member receives an intermediate reaction force from the return spring through engagement with the return spring, and the full close position limiting member receives a full close side engaging force from the valve gear. The full close side engaging force and the intermediate reaction force are generally directed in a predetermined direction.

8 Claims, 6 Drawing Sheets

(56) References Cited

U.S. PATENT DOCUMENTS

| | | | | |
|---|---|---|---|---|
| 6,173,939 | B1 * | 1/2001 | Dottavio et al. | 251/129.12 |
| 6,267,099 | B1 * | 7/2001 | Yamada et al. | 123/396 |
| 6,286,481 | B1 * | 9/2001 | Bos et al. | 123/399 |
| 6,341,593 | B2 * | 1/2002 | Kamimura et al. | 123/337 |
| 6,347,613 | B1 * | 2/2002 | Rauch | 123/337 |
| 6,360,718 | B1 * | 3/2002 | Wicker | 123/396 |
| 6,382,180 | B2 * | 5/2002 | Wayama et al. | 123/399 |
| 6,386,178 | B1 * | 5/2002 | Rauch | 123/337 |
| 6,513,491 | B1 * | 2/2003 | Harvey | 123/361 |
| 6,543,417 | B2 * | 4/2003 | Tanaka et al. | 123/399 |
| 6,568,652 | B2 * | 5/2003 | Kaiser et al. | 251/69 |
| 6,575,427 | B1 * | 6/2003 | Rauch et al. | 251/69 |
| 6,598,587 | B2 * | 7/2003 | Kamimura et al. | 123/399 |
| 6,622,984 | B2 * | 9/2003 | Rauch et al. | 251/71 |
| 6,874,470 | B2 * | 4/2005 | Hedrick et al. | 123/396 |
| 6,912,994 | B2 * | 7/2005 | Ozeki et al. | 123/399 |
| 6,925,986 | B2 * | 8/2005 | Cannone et al. | 123/396 |
| 6,973,913 | B2 * | 12/2005 | Knorpp et al. | 123/396 |
| 7,013,870 | B2 * | 3/2006 | Kamimura et al. | 123/399 |
| 7,028,666 | B2 * | 4/2006 | Kamimura et al. | 123/399 |
| 7,063,067 | B2 * | 6/2006 | Kado et al. | 123/399 |
| 7,302,931 | B2 * | 12/2007 | Saito et al. | 123/396 |
| RE40,350 | E * | 6/2008 | Kotchi et al. | 123/396 |
| 7,503,309 | B2 * | 3/2009 | Tanimura et al. | 123/396 |
| 7,536,993 | B2 * | 5/2009 | Tsukiji et al. | 123/399 |
| 7,543,794 | B2 * | 6/2009 | Kouzu et al. | 251/129.11 |
| 2004/0084016 | A1 * | 5/2004 | Torii et al. | 123/399 |

* cited by examiner

THROTTLE APPARATUS FOR INTERNAL COMBUSTION ENGINE

CROSS REFERENCE TO RELATED APPLICATION

This application is based on and incorporates herein by reference Japanese Patent Application No. 2010-115367 filed on May 19, 2010.

BACKGROUND OF THE INVENTION

1. Field of the Invention

The present invention relates to a throttle apparatus for an internal combustion engine.

2. Description of Related Art

For instance, Japanese Unexamined Patent Publication No. 2009-185679A teaches a throttle apparatus that has a valve, an opening degree of which is adjusted by a drive motor to change a quantity of intake air supplied to an internal combustion engine.

Specifically, with reference to FIG. 6, the throttle apparatus 100 of Japanese Unexamined Patent Publication No. 2009-185679A includes a throttle body 102, the valve 103, a return spring 106, the motor 105, a plurality of output force transmission gears 107, a full close position stopper 134 and an intermediate position stopper 140. The throttle body 102 forms an intake passage, which conducts the intake air and is connected to the internal combustion engine. The valve 103 is rotatably received in the intake passage to change an opening degree of the intake passage. The return spring 106 urges the valve 103 from both of a full open position side and a full close position side of the valve 103 toward a predetermined intermediate position between a full close position and a full open position of the valve 103. The motor 105 drives the valve 103 in the opening direction (toward the open side) or in the closing direction (toward the close side) against the urging force of the return spring 106. The output force transmission gears 107 transmit the output force of the motor 105 to the valve 103. The full close position stopper 134 is adapted to engage with a valve gear 126, which is one of the output force transmission gears 107, when the valve 103 is driven in the closing direction (toward the close side) and reaches the full close position. The intermediate position stopper 140 is adapted to engage with the return spring 106 when the valve 103 is placed on the full close position side of the intermediate position.

The full close position stopper 134 receives the full close side engaging force, which is applied from the valve gear 126 at the time of engaging with the valve gear 126, at a point Q of action in the left-to-right direction in FIG. 6. The intermediate position stopper 140 receives an intermediate reaction force from the return spring 106 through the engagement with the return spring 106 at a point P of action in the top-to-bottom direction in FIG. 6.

The intermediate reaction force is always applied to the intermediate position stopper 140 in a range of valve opening degree (a valve opening degree range), which is equal to or smaller than an intermediate valve opening degree and in which the valve 103 is most frequently operated. Therefore, in a case where the throttle body 102 is made of a resin material, which has a low modulus of elasticity, a creep deformation tends to occur at the intermediate position stopper 140. Thus, a deviation in a relative position between the point P of action of the intermediate reaction force at the intermediate position stopper 140 and the point Q of action of the full close side engaging force at the full close position stopper 134 is likely to occur. Specifically, the point P of action of the intermediate position stopper 140 irreversibly moves toward the close side (top side in FIG. 6) upon deformation thereof while the point Q of action of the full close position stopper 134 is kept still without movement. Therefore, at the time of fully closing the valve 103, when the valve 103 is moved from the intermediate position to the full close position, the valve gear 126 may hardly collide against the full close position stopper 134 in some cases.

SUMMARY OF THE INVENTION

The present invention is made in view of the above disadvantage. According to the present invention, there is provided a throttle apparatus for an internal combustion engine, including a body, a valve, means for urging the valve (hereinafter referred to as urging means), an electric motor, a plurality of output force transmission members, a full close position limiting member and an intermediate position limiting member. The body forms an intake passage, which is communicated with the internal combustion engine. The valve is rotatably received in the intake passage and is adapted to be driven to adjust an opening degree of the valve in the intake passage. The urging means urges the valve toward a predetermined intermediate position between a full close position and a full open position of the valve from both of a full close position side and a full open position side of the valve. The electric motor is adapted to provide an output force upon energization thereof to drive the valve in a corresponding one of an opening direction and a closing direction of the valve against an urging force of the urging means. The output force transmission members cooperate together to conduct the output force of the electric motor to the valve. The full close position limiting member is adapted to be engaged with a predetermined one of the plurality of output force transmission members to limit further movement of the predetermined one of the plurality of output force transmission members when the valve is driven in the valve closing direction and reaches the full close position of the valve. The intermediate position limiting member is adapted to be engaged with the urging means when the valve is placed on a side of the predetermined intermediate position where the full close position of the valve is located. The full close position limiting member receives a full close side engaging force from the predetermined one of the output force transmission members when the predetermined one of the output force transmission members is engaged with the full close position limiting member. The intermediate position limiting member receives an intermediate reaction force from the urging means through the engagement with the urging means. The full close side engaging force, which is applied to the full close position limiting member, and the intermediate reaction force, which is applied to the intermediate position limiting member, are generally directed in a predetermined direction. The intermediate position limiting member is adapted to conduct the intermediate reaction force to the full close position limiting member, and the full close position limiting member is adapted to be deformed by the conducted intermediate reaction force generally in the predetermined direction. A point of action of the full close side engaging force at the full close position limiting member is adapted to move generally in the predetermined direction upon the deformation of the full close position limiting member generally in the predetermined direction.

The full close position limiting member may include a first planar portion and a second planar portion. The first planar portion has a generally uniform thickness measured in a direction perpendicular to a plane of the first planar portion and includes a first end part joined to an inner peripheral wall surface of the body. The second planar portion has a generally uniform thickness measured in a direction perpendicular to a plane of the second planar portion. The second planar portion includes a first end part and a second end part. The first end part of the second planar portion is joined to the inner peripheral wall surface of the body, and the second end part of the second planar portion is joined to a second end part of the first planar portion to define a generally right angle between the first planar portion and the second planar portion. The intermediate position limiting member may include a first planar portion and a second planar portion. The first planar portion has a generally uniform thickness measured in a direction perpendicular to a plane of the first planar portion and is generally parallel to the first planar portion of the full close position limiting member. The first planar portion of the intermediate position limiting member includes a first end part joined to the inner peripheral wall surface of the body. The second planar portion has a generally uniform thickness measured in a direction perpendicular to a plane of the second planar portion and is generally parallel to the second planar portion of the full close position limiting member. The second planar portion of the intermediate position limiting member includes a first end part and a second end part. The first end part of the second planar portion is joined to a center part of the first planar portion of the full close position limiting member, which is centered between the first end part and the second end part of the first planar portion of the full close position limiting member, and the second end part of the second planar portion is joined to a second end part of the first planar portion of the intermediate position limiting member to define a generally right angle between the first planar portion and the second planar portion of the intermediate position limiting member.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to FIGS. 1 to 4.

Figure 1:
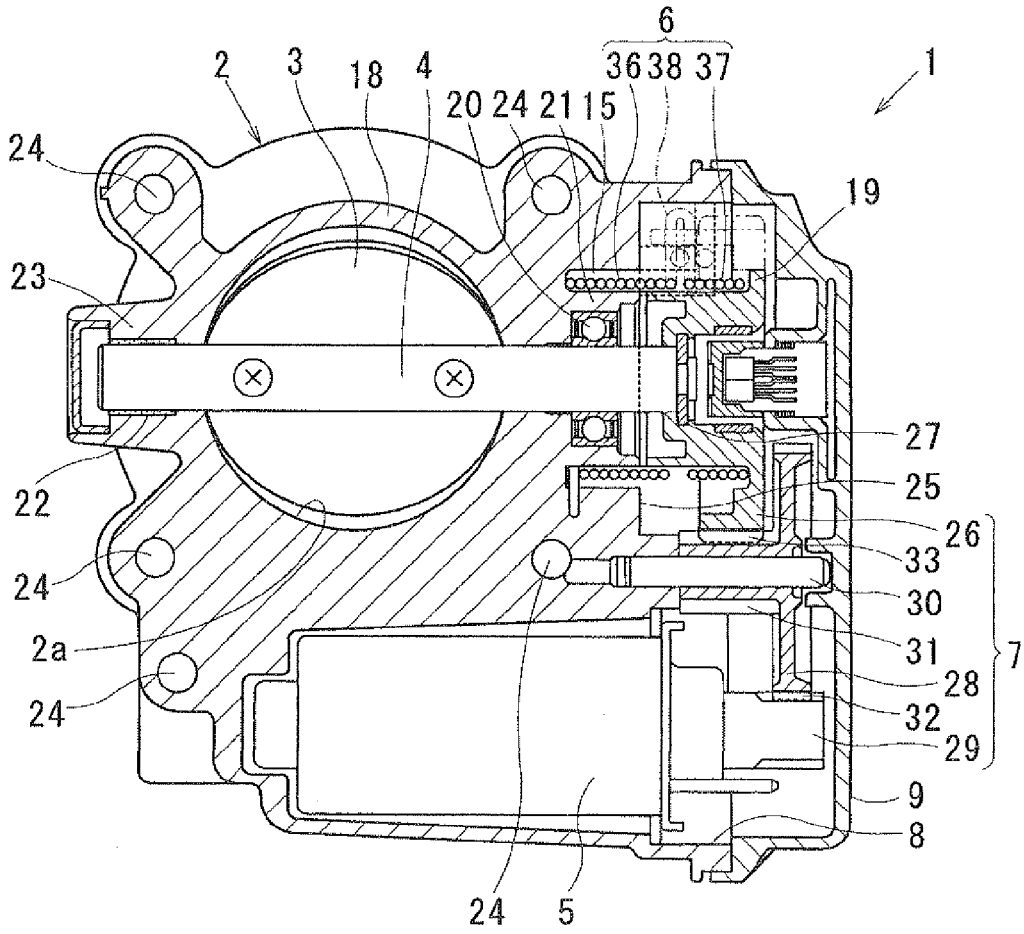
FIG. 1 is a front cross-sectional view showing an entire structure of a throttle apparatus according to an embodiment of the present invention.

With reference to FIG. 1, a throttle apparatus 1 of the present embodiment includes a throttle body (also simply referred to as a body) 2, a throttle valve 3, a throttle shaft (rotatable shaft) 4, a drive motor 5, a return spring 6 and a speed reducing gear device 7. The throttle body 2 forms an intake passage 2*a*, which is configured into a cylindrical tubular form and conducts intake air (also simply referred to as air). The throttle valve 3 adjusts a quantity of the intake air (also referred to as an intake air quantity). The throttle shaft 4 holds the throttle valve 3 integrally therewith and is rotatably supported by the throttle body 2 through bearings. The drive motor 5 is an electric motor that drives the throttle shaft 4 to rotate the same upon energization thereof. The return spring (serving as intermediate position urging means or simply referred to as urging means) 6 urges the throttle valve 3 in a full close direction and a full open position thereof. The speed reducing gear device 7 includes a plurality of output force transmission members (gears) 26, 28, 29, which cooperate together to conduct the rotational output force of the drive motor 5 to the throttle shaft 4.

The speed reducing gear device 7 is received in a gear case 8, which is formed in an end part (right end part in FIG. 1) of the throttle body 2, and a gear cover 9 is installed to an opening of the gear case 8 to limit intrusion of dust into the inside of the gear case 8.

The throttle apparatus 1 is connected to an undepicted engine control unit (ECU), which controls supply of an electric power to the drive motor 5, and thereby the throttle apparatus 1 constitutes a part of an intake system of the engine. The throttle apparatus 1 is controlled by the ECU to control the output force and the rotational speed of the engine by adjusting the quantity of the intake air, which is supplied to the engine, based on the amount of depression of an accelerator pedal of a vehicle (e.g., an automobile). An accelerator opening degree sensor (not shown) is connected to the ECU. The accelerator opening degree sensor converts the amount of depression of the accelerator pedal into a corresponding electrical signal (an accelerator opening degree signal) and outputs it to the ECU as a signal indicating an accelerator operational amount.

The throttle body 2 is made of a metal material (e.g., an aluminum die casting) or a resin material. The throttle body 2 forms a housing that rotatably holds the throttle valve 3 in a range from a full close position to a full open position thereof in the intake passage 2*a*, which is formed in a bore wall portion 18 having a cylindrical tubular form and is configured to have a generally circular cross section. The throttle body 2 is securely fixed to an intake manifold (not shown) of the engine with fixing elements (e.g., screws). A plurality of receiving holes 24 is formed in an outer peripheral part of the bore wall portion 18 to receive fixing elements (e.g., fixing bolts).

The throttle body 2 has two bearing receiving portions 21, 23, each of which is configured into a cylindrical tubular form. The bearing receiving portion 23 is provided in the one end part of the throttle body 2 to rotatably support one end part (left end part in FIG. 1) of the throttle shaft 4 through a plain bearing 22. The bearing receiving portion 21 is provided in the other end part of the throttle body 2 to rotatably support the other end part (right end part in FIG. 1) of the throttle shaft 4 through an antifriction bearing (ball bearing) 20.

The throttle valve 3 is a butterfly valve, which is a generally circular disk made of a metal material or a resin material and adjusts a quantity (an intake air quantity) of air drawn into the engine. In an installed state where the throttle valve 3 is fitted to a valve receiving hole (not shown) formed in a valve holding portion of the throttle shaft 4, the throttle valve 3 is fixed to the throttle shaft 4 with fixing elements (e.g., fixing screws), so that the throttle valve 3 is rotatable integrally with the throttle shaft 4.

The throttle shaft 4 is configured into a cylindrical rod form and is made of a metal material. The end parts of the throttle shaft 4 are rotatably supported by the bearing receiving portions 21, 23 of the throttle body 2. A valve gear 26, which is a constituent member (more specifically, one of the output force transmission members) of the speed reducing gear device 7, is fixed to the other end part of the throttle shaft 4 such that the other end part of the throttle shaft 4 and an annular plate 27, which is insert molded in an inner peripheral part of the valve gear 26, are fixed together by swaging the annular plate 27 against the other end part of the throttle shaft 4.

The drive motor 5 serves as an electric actuator (drive source) and has a motor shaft, which is rotatable in both of forward and backward directions upon energization. The speed reducing gear device 7 reduces a speed (rotational speed) of rotation, which is transmitted from the drive motor 5, to a rotational speed of the throttle shaft 4. The speed reducing gear device 7 includes the valve gear 26, an intermediate gear 28 and a pinion gear 29, which serve as the output force transmission members. The valve gear 26 is fixed to the other end part of the throttle shaft 4, and the intermediate gear 28 is meshed with the valve gear 26. The pinion gear 29 is fitted to the motor shaft of the drive motor 5.

The intermediate gear 28 is molded with a resin material and has a two-step spur gear structure. Specifically, the intermediate gear 28 includes a small diameter gear 31 and a large diameter gear 32. The small diameter gear 31 is meshed with the valve gear 26. The large diameter gear 32 is meshed with the pinion gear 29. The intermediate gear 28 is rotatably fitted to an intermediate shaft 30. One end part of the intermediate shaft 30 is securely press fitted into a boss portion, which is formed in a side wall surface 25 of the bore wall portion 18 of the throttle body 2, and the other end part of the intermediate shaft 30 is supported by a hole of a boss portion, which is formed in an inner wall surface of the gear cover 9. Thereby, swing motion of the intermediate shaft 30 is limited. The pinion gear 29 is a drive gear, which is formed with a metal material (sintered metal material) and is fitted to the motor shaft (output shaft) of the drive motor 5 to rotate integrally therewith.

Figure 2A:
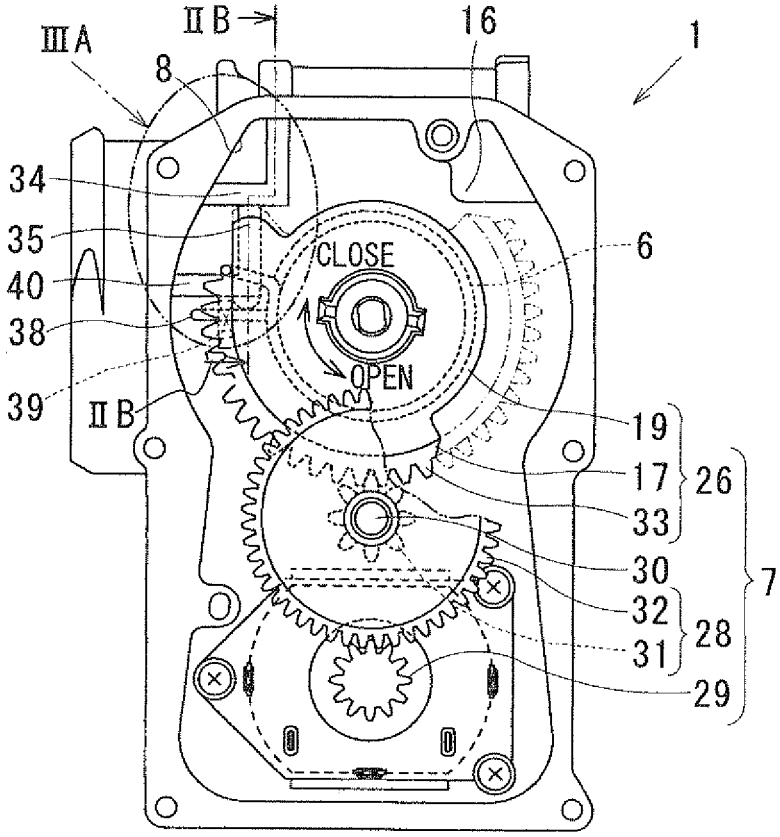
FIG. 2A is a side view taken from the right side in FIG. 1 upon removing a gear cover, showing a gear case of the throttle apparatus.
Figure 2B:
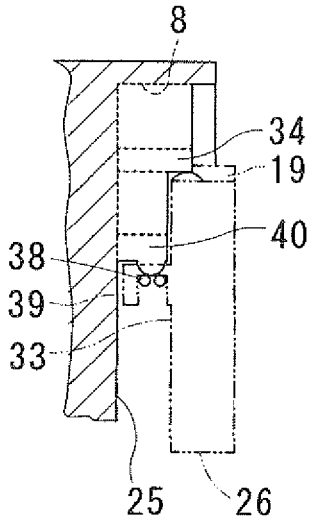
FIG. 2B is a cross-sectional view taken along line IIB-IIB in FIG. 2A.

With reference to FIGS. 2A and 2B, the valve gear 26 is made of a resin material and is configured into a generally circular disk form. A gear portion 33, which includes gear teeth meshed with the small diameter gear 31 of the intermediate gear 28, is formed partially along a lower side region of an outer peripheral part of the valve gear 26 in FIG. 2A. The gear portion 33, which is formed partially along the outer peripheral part of the valve gear 26, has a maximum opening degree of about 90 degrees, which is measured from the full close position to the full open position of the throttle valve 3. Therefore, the gear portion 33 is formed along the outer peripheral part of the valve gear 26 through an angular range, which is slightly larger than 90 degrees. The remaining region of the outer peripheral part of the valve gear 26 forms a boss portion 19, in which a gear tooth is not formed.

A full close side stopper portion (engaging portion) 35 is formed integrally in a boundary part between a close side end part (upper end part in FIG. 2A) of the gear portion 33 and the boss portion 19 in the valve gear 26. The full close side stopper portion 35 is engaged with a full close position stopper (full close position limiting member) 34, which limits the full close position of the throttle valve 3 when the throttle valve 3 is fully closed. A full open side stopper portion (engaging portion) 17 is formed integrally in a boundary part between an open side end part (opposite from the close side end part) of the gear portion 33 and the boss portion 19 in the valve gear 26. The full open side stopper portion 17 is engaged with a full open position stopper 16, which limits the full open position of the throttle valve 3, when the throttle valve 3 is fully opened.

Furthermore, an opener portion 39, which will be described later, projects in the axial direction of the valve gear 26 at a predetermined intermediate position between the full close side and the full open side of the gear portion 33 in the valve gear 26. An engaging portion, which has a U-shaped guide and is engageable with a U-shaped hook portion 38 of a return spring 6, is formed integrally in one end part of the opener portion 39. This U-shaped engaging portion of the opener portion 39 limits axial movement (axial deviation) of the U-shaped hook portion 38 of the return spring 6.

As shown in FIG. 1, a return spring receiving portion 15, which is configured into a cylindrical recess (annular recess), is formed in the end part (right end part in FIG. 1) of the throttle body 2, i.e., the gear case 8. The return spring receiving portion 15 is coaxial with the bearing receiving portion 21, which supports the throttle shaft 4, and the return spring 6 is received in the return spring receiving portion 15.

The return spring 6 includes a return spring portion 36 and a default spring portion 37, which are made as coil springs, respectively. A winding direction of the return spring portion 36 and a winding direction of the default spring portion 37 are opposite to each other. A connecting portion between the return spring portion 36 and the default spring portion 37 is bent into a U-shape form to form the U-shaped hook portion 38, which is engaged with an intermediate position stopper (serving as an intermediate position limiting member) 40 that limits an intermediate position described below (see FIGS. 2A and 2B).

The return spring portion 36 is a first spring (first spring portion), which is formed by spirally winding a spring steel material (wire) and has a returning function to urge the throttle valve 3 from the full open position to the intermediate position through the opener portion 39. One end part (right end part in FIG. 1) of the return spring portion 36 is engaged to or is held by a body side spring hook (not shown), which is formed integrally in a bottom wall surface of the return spring receiving portion 15 that is formed in the end part of the bore wall portion 18 of the throttle body 2.

The default spring portion 37 is a second spring (second spring portion), which is formed by spirally winding the spring steel material (wire) and has an opening function to urge the throttle valve 3 from the full close position to the intermediate position (intermediate opening degree position) through the opener portion 39. The other end part of the default spring portion 37 is engaged to or is held by a valve gear side spring hook (not shown) of the opener portion 39 of the valve gear 26.

As shown in FIGS. 2A and 2B, the full close position stopper 34 is formed at an upper left end side of the gear case 8 and is configured into a rib form. The full close position stopper 34 is connected to, i.e., joined to a surface of an inner peripheral wall of the gear case 8 and projects to a predetermined height from the side wall surface 25 of the bore wall portion 18, which forms the bottom portion of the gear case 8. The full close position stopper 34 is a limiting portion, to which the full close side stopper portion 35 is engaged when the throttle valve 3 is driven in the closing direction (toward the closing side) and reaches the full close position. Thereby, the full close position stopper 34 limits excessive rotation of the throttle valve 3.

The intermediate position stopper 40, which is configured into a rib form, is formed at the upper left end side of the gear case 8 in FIG. 2A. The intermediate position stopper 40 is connected to, i.e., joined to the surface of the inner peripheral wall of the gear case 8 and projects to a predetermined height from the side wall surface 25 of the bore wall portion 18. The U-shaped hook portion 38 is engaged with the intermediate position stopper 40 to mechanically hold the throttle valve 3 in the predetermined intermediate opening degree position (predetermined intermediate position) between the full close portion and the full open position of the throttle valve 3 through use of the urging force of the return spring portion 36 and the urging force of the default spring portion 37, which are exerted in the opposite directions, respectively.

Therefore, the throttle valve 3 can be held in the intermediate opening degree position (intermediate position), at which a predetermined valve opening angle of the throttle valve 3 is achieved, in the state where the engine is stopped (the state where the ignition switch is held in an OFF position), or in the state where the supply of the electric current to the drive motor 5 is blocked, i.e., is stopped for some reason. That is, it allows a limp-home mode drive of the vehicle.

The gear cover 9 is made of dielectric thermoplastic resin, which electrically insulates between each adjacent terminals of a throttle valve position sensor (e.g., Hall elements). The gear cover 9 has a connecting end surface, which is configured into a flange form and is securely fixed, with fixing elements (e.g., screws), to a connecting end surface, which is configured into a flange form and is provided in the opening of the gear case 8 that receives the speed reducing gear device 7. An annular seal member (e.g., a rubber packing or grommet, or a gasket not shown) is installed between these connecting end surfaces to limit intrusion of foreign objects (e.g., dust) into the inside of the gear cover 9.

Figure 3A:
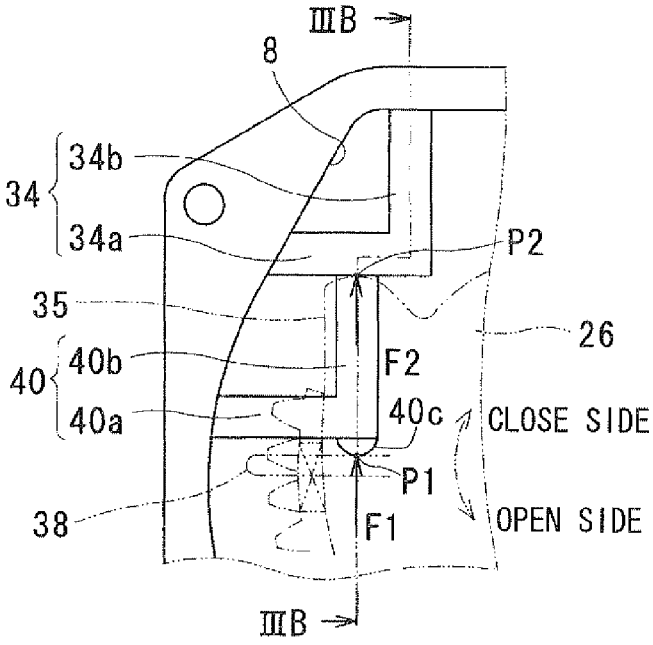
FIG. 3A is a partial enlarged view of an area IIIA in FIG. 2A.
Figure 3B:
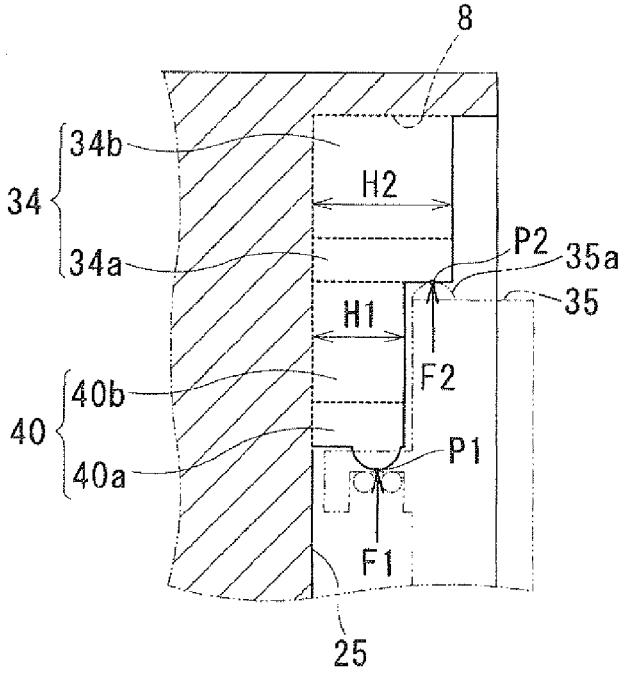
FIG. 3B is a cross-sectional view taken along line IIIB-IIIB in FIG. 3A.

Now, the intermediate position stopper 40 and the full close position stopper 34 will be described in detail. According to the present embodiment, as shown in FIGS. 3A and 3B, the intermediate position stopper 40 is connected to and is aligned with the full close position stopper 34 in series. The intermediate position stopper 40 is engaged with the U-shaped hook portion 38 and is adapted to hold the throttle valve 3 in the predetermined intermediate opening degree position, and the full close position stopper 34 is adapted to engage with the full close side stopper portion 35 of the valve gear 26 when the throttle valve 3 is driven in the closing direction (toward the closing side) and is reached to the full close position. That is, an application direction of an intermediate reaction force F1 of the U-shaped hook portion 38, which is applied to the intermediate position stopper 40, is set to be generally the same as an application direction of a full close side engaging force F2 of the full close side stopper portion 35 of the valve gear 26, which is applied to the full close position stopper 34 at the time of contacting the full close side stopper portion 35 against the full close position stopper 34.

Hereinafter, this common direction will be defined as a predetermined direction for descriptive purpose. The intermediate position stopper 40 includes an intermediate reaction force receiving portion (first planar portion) 40*a* and an intermediate reaction force conducting portion (second planar portion) 40*b*. The intermediate reaction force receiving portion 40*a* supports the intermediate reaction force F1 and extends in a direction, which is generally parallel to the U-shaped hook portion 38 and is generally perpendicular to the predetermined direction. The intermediate reaction force conducting portion 40*b* conducts the intermediate reaction force F1, which is applied to the intermediate reaction force receiving portion 40*a*, to the full close position stopper 34. The intermediate reaction force receiving portion 40*a* is also placed generally parallel to a portion of the full close position stopper 34, as discussed below. The intermediate reaction force conducting portion 40*b* is placed generally parallel to the predetermined direction and is generally perpendicular to the intermediate reaction force receiving portion 40*a* and to a full close side engaging force receiving portion 34*a* (described in detail below).

The intermediate reaction force receiving portion 40*a* has a generally uniform thickness (plate thickness), and the intermediate reaction force conducting portion 40*b* has a generally uniform thickness (plate thickness). The thickness (plate thickness) of the intermediate reaction force receiving portion 40*a* and the thickness (plate thickness) of the intermediate reaction force conducting portion 40*b* are generally identical to each other. The intermediate reaction force receiving portion 40*a* and the intermediate reaction force conducting portion 40*b* form the rib structure, which projects from the side wall surface 25 of the throttle body 2 by the height H1 in the axial direction (left-to-right direction in FIG. 3B) of the throttle shaft 4. Furthermore, the intermediate reaction force receiving portion 40*a* includes a protruding curved surface 40*c* (i.e., a protrusion having a curved surface, preferably a semispherical surface), which is placed to coincide with, i.e., to be centered to a central axis of the intermediate reaction force conducting portion 40*b*, which is centered in the intermediate reaction force conducting portion 40*b* in the plate thickness direction thereof, i.e., in the left-to-right direction in FIG. 3A. Therefore, the U-shaped hook portion 38 can be engaged with the intermediate reaction force receiving portion 40*a* at a predetermined location where the protruding curved surface 40*c* is provided. Thus, the intermediate reaction force F1 of the U-shaped hook portion 38 is always applied in the axial direction of the intermediate reaction force conducting portion. Alternatively, the protruding curved surface 40*c* may be eliminated to have the planar surface, if desired.

The full close position stopper 34 includes the full close side engaging force receiving portion (first planar portion) 34*a* and a full close side engaging force supporting portion (second planar portion) 34*b*. The full close side engaging force receiving portion 34*a* receives the full close side engaging force F2. The full close side engaging force supporting portion 34*b* supports the full close side engaging force F2, which is applied to the full close side engaging force receiving portion 34*a*. The full close side engaging force receiving portion 34*a* is placed generally parallel to the intermediate reaction force receiving portion 40*a*, and the full close side engaging force supporting portion 34*b* is placed generally perpendicular to the full close side engaging force receiving portion 34*a*. The end part of the full close side engaging force supporting portion 34*b*, which is opposite from the full close side engaging force receiving portion 34*a*, is connected to, i.e., joined to the surface of the inner peripheral wall of the gear case 8.

The full close side engaging force receiving portion 34*a* has a generally uniform thickness (plate thickness), and the full close side engaging force supporting portion 34*b* has a generally uniform thickness (plate thickness). The thickness (plate thickness) of the full close side engaging force receiving portion 34*a* and the thickness (plate thickness) of the full close side engaging force supporting portion 34*b* are generally identical to each other. The full close side engaging force receiving portion 34*a* and the full close side engaging force supporting portion 34*b* form the rib structure, which projects from the side wall surface 25 of the throttle body 2 by the height H2 in the axial direction (left-to-right direction in FIG. 3B) of the throttle shaft 4. The intermediate reaction force conducting portion 40*b* is joined to a center part (center part in the left-to-right direction in FIG. 3A) of the full close side engaging force receiving portion 34*a* in the direction generally perpendicular to the full close side engaging force receiving portion 34*a*, so that the full close side engaging force receiving portion 34*a* and the intermediate reaction force conducting portion 40*b* are integrally formed. A receiving surface of the full close side engaging force receiving portion 34*a*, which receives the full close side engaging force from the full close side stopper portion 35, is planar, and the full close side engaging force is applied to the receiving surface of the full close side engaging force receiving portion 34*a* from the protruding curved surface (protrusion having the curved surface, preferably the semispherical surface) 35*a* formed in the full close side stopper portion 35. In this way, the point P2 of action of the full close side engaging force can be easily placed at the single point.

In this way, the center part of the full close side engaging force receiving portion 34*a* is adapted to be deformed in the application direction of the intermediate reaction force, i.e., in the predetermined direction by the intermediate reaction force conducted from the intermediate reaction force conducting portion 40*b*. At this time, when the point P2 of action of the full close side engaging force, which is applied to the full close side engaging force receiving portion 34*a*, coincides with the central axis of the intermediate reaction force conducting portion 40*b*, the point P2 of action of the full close side engaging force is displaced in the predetermined direction by the amount, which corresponds to the amount of deformation of the center part of the full close side engaging force receiving portion 34*a*.

The full close position stopper 34 and the intermediate position stopper 40 are all configured into the plate form (L-shape plate form, in which the two planar portions are joined together to have an L-shape), and the plate thickness is generally uniform and the same in both of the full close position stopper 34 and the intermediate position stopper 40. In this way, the full close position stopper 34, the intermediate reaction force receiving portion 40*a* and the intermediate reaction force conducting portion 40*b* are generally uniformly shrunk without locally accumulating a heat in a cooling process after the molding process (or the forming process). Therefore, it is possible to increase the positional accuracy of the point P1 of action of the intermediate reaction force and the point P2 of action of the full close side engaging force.

In the throttle control operation using the throttle apparatus 1 of the present embodiment, the frequency of the operation of the throttle valve 3 at the valve opening degrees, which are equal to or smaller than the intermediate opening degree, is very high, and the intermediate opening degree position of the throttle valve 3 is maintained even at the time of parking, i.e., stopping the vehicle upon the stopping of the engine. Therefore, the urging force is always applied to the U-shaped hook portion 38, and the intermediate reaction force F1 is applied to the intermediate position stopper 40. Therefore, the intermediate position stopper 40 is likely to have a creep deformation (creep strain). The creep deformation is different from a reversible strain generated in response to a load applied in a resilient deformation and is also different from an irreversible strain generated in response to a load applied in plastic deformation. That is, the creep deformation is a strain, which is irreversibly and progressively increased with time even under application of the constant load.

Figure 4:
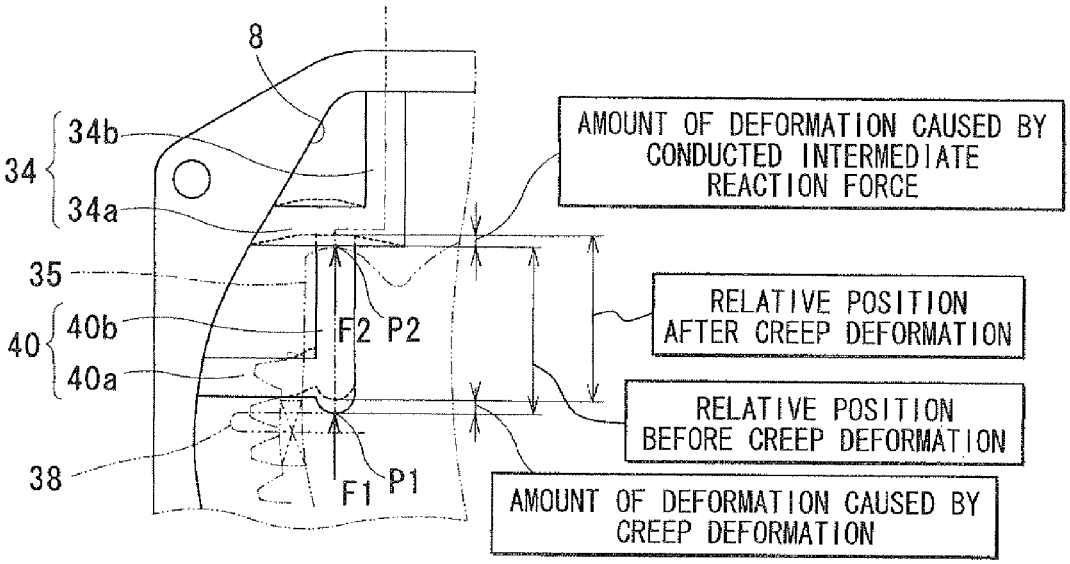
FIG. 4 is a descriptive view showing a main feature of the throttle apparatus of the embodiment.

Therefore, when the creep deformation is generated with time in the intermediate position stopper 40 by the intermediate reaction force F1, the point P1 of action of the intermediate reaction force F1 is depressed, i.e., is displaced in the application direction of the intermediate reaction force F1, and this deformation is transmitted to the intermediate reaction force conducting portion 40*b* to cause a deformation in the center part of the full close side engaging force receiving portion 34*a*, as shown in FIG. 4. That is, the amount of deformation caused by the creep deformation of the point P1 of action of the intermediate reaction force F1 is generally the same as the amount of deformation of the center part of the full close side engaging force receiving portion 34*a*. Therefore, it looks like that the point P1 of action and the point P2 of action along the line of action of the intermediate reaction force F1 are translated (i.e., make a translational movement along the line of action of the intermediate reaction force F1) while substantially maintaining the initial distance (substantially constant distance) between the point P1 of action and the point P2 of action. Therefore, there is no substantial deviation in the positional relationship between them.

The operation of the throttle apparatus 1 of the present embodiment will be described with reference to FIGS. 1 to 3B.

When the driver of the vehicle depresses the accelerator pedal, the corresponding accelerator opening degree signal (the signal indicating the amount of depression of the accelerator pedal) is supplied to the ECU. Then, the ECU energizes the drive motor 5 to rotate the motor shaft of the drive motor 5 such that the opening degree of the throttle valve 3 coincides with a corresponding predetermined opening degree. The torque of the drive motor 5 is conducted to the valve gear 26 through the pinion gear 29 and the intermediate gear 28. In this way, the valve gear 26 is rotated, so that the throttle shaft 4 is rotated by a corresponding predetermined rotational angle. Thus, the throttle valve 3 is rotated from the intermediate opening degree position toward the full open position, so that the intake passage 2*a* defined in the bore wall portion 18 is opened by a corresponding predetermined opening degree. At this time, the urging force of the default spring portion 37 is not involved in the rotation of the throttle valve 3 toward the valve open side, and the opener portion 39 is maintained in the state where the opener portion 39 is held between the U-shaped hook portion 38 and the valve gear side spring hook.

In contrast, when the driver releases the accelerator pedal from the depressed position, the motor shaft of the drive motor 5 is rotated in the opposite direction, and the throttle valve 3, the throttle shaft 4 and the valve gear 26 are also rotated in the opposite direction. Thereby, the throttle shaft 4 is rotated by a corresponding predetermined angle, and thereby the throttle valve 3 is rotated from the intermediate operational position to the full close position. When the full close side stopper portion 35, which is formed integrally in the outer peripheral portion of the valve gear 26, contacts, i.e., engages the full close position stopper 34, the throttle valve 3 is held in the full close position. At this time, the urging force of the return spring portion 36 is not involved in the rotation of the throttle valve 3 toward the valve close side. The flow direction of the electric current, which flows through the drive motor 5, is reversed at the intermediate operational position.

When the supply of the electric current to the drive motor 5 is blocked, i.e., is stopped for some reason, the engaging portion of the opener portion 39 is held in the contact state where the engaging portion of the opener portion 39 contacts, i.e., engages the U-shaped hook portion 38. This is made possible by the returning function of the return spring portion 36, i.e., the urging force of the return spring portion 36, which urges the throttle valve 3 from the full open position to the intermediate position through the opener portion 39, and the opening function of the default spring portion 37, i.e., the urging force of the default spring portion 37, which urges the throttle valve 3 from the full close position to the intermediate position through the opener portion 39. In this way, the throttle valve 3 is reliably held in the intermediate opening degree position. Therefore, even in the case where the supply of the electric current to the drive motor 5 is blocked for some reason, the engine is not stopped to allow the limp-home mode drive of the vehicle.

Furthermore, even when the vehicle is parked by turning off the ignition switch, the throttle valve 3 is always held in the intermediate opening degree position. Even at the time of parking the vehicle, the intermediate reaction force F1, which is generated by the urging force of the return spring 6, is always applied to the intermediate position stopper 40.

Now, advantage of the embodiment will be described.

In the present embodiment, the full close position stopper 34, which receives the full close side engaging force F2 from the valve gear 26, and the intermediate position stopper 40, which receive the intermediate reaction force F1 from the return spring 6, are aligned in series such that the application direction of the full close side engaging force F2 to the full close position stopper 34 is generally the same as the application direction of the intermediate reaction force F1 to the intermediate position stopper 40.

Furthermore, the intermediate position stopper 40 is placed such that the intermediate reaction force conducting portion 40*b*, which conducts the intermediate reaction force F1 to the full close position stopper 34, is placed parallel to the application direction of the intermediate reaction force F1, and the portion of the full close position stopper 34 is adapted to be deformed by the conducted intermediate reaction force F1 in the application direction of the full close side engaging force F2 to displace the point P2 of action of the full close side engaging force F2 at the full close position stopper 34 to the corresponding displaced point, which is displaced by the deformation of the full close position stopper 34.

In this way, the intermediate position stopper 40 is deformed through the creep deformation such that the portion of the intermediate position stopper 40, which includes the point P1 of action of the intermediate reaction force F1, is dented in the application direction of the intermediate reaction force F1, so that the full close position stopper 34 is deformed generally in the same direction as that of the portion of the intermediate position stopper 40, and thereby the point P2 of action of the full close side engaging force F2 at the full close position stopper 34 is also displaced generally in the same direction. Thereby, even when the intermediate position stopper 40 is deformed by the creep deformation, it is possible to limit the deviation in the relative position between the point P1 of action of the intermediate reaction force F1 at the intermediate position stopper 40 and the point P2 of action of the full close side engaging force F2 at the full close position stopper 34.

Furthermore, the intermediate position stopper 40 includes the intermediate reaction force receiving portion 40*a*, which receives the intermediate reaction force F1 through the engagement with the return spring 6, and the intermediate reaction force conducting portion 40*b*, which conducts the intermediate reaction force F1 from the intermediate reaction force receiving portion 40*a* to the full close position stopper 34. The full close position stopper 34, the intermediate reaction force receiving portion 40*a* and the intermediate reaction force conducting portion 40*b* are all formed into the corresponding plate form.

Furthermore, the intermediate reaction force receiving portion 40*a* and the portion (more specifically, the full close side engaging force receiving portion 34*a*) of the full close position stopper 34 are parallel to each other and perpendicular to the application direction of the intermediate reaction force F1. The intermediate reaction force conducting portion 40*b* is parallel to the application direction of the intermediate reaction force F1 and is perpendicular to the intermediate reaction force receiving portion 40*a* and the full close side engaging force receiving portion 34*a*. The plate thickness of the full close position stopper 34, the plate thickness of the intermediate reaction force receiving portion 40*a* and the plate thickness of the intermediate reaction force conducting portion 40*b* are generally the same (generally identical).

In this way, the full close position stopper 34, the intermediate reaction force receiving portion 40*a* and the intermediate reaction force conducting portion 40*b* are generally uniformly shrunk without locally accumulating the heat in the cooling process after the molding process (or the forming process). Therefore, the positional accuracy of the point P1 of action of the intermediate reaction force F1 and the positional accuracy of the point P2 of action of the full close side engaging force F2 can be improved.

Furthermore, the intermediate position stopper 40 has the protruding curved surface 40*c*, and the point P1 of action of the intermediate reaction force F1 is formed on this protruding curved surface 40*c*.

In this way, even when the point P1 of action of the intermediate reaction force F1 is deviated by the dent (depression) caused by the creep deformation of the intermediate position stopper 40, the point P1 of action of the intermediate reaction force F1 is formed on the curved surface, so that the surface area, which receives the intermediate reaction force F1, is always kept constant. Therefore, it is possible to limit an increase in the surface pressure of the intermediate reaction force F1 at the point P1 of action of the reaction force F1, and thereby a degree of progress of the creep deformation at the intermediate position stopper 40 can be kept at generally a constant pace.

Now, modifications of the above embodiment will be described.

In the above embodiment, the application direction of the intermediate reaction force F1, which is applied to the intermediate position stopper 40 that is engaged with the U-shaped hook portion 38 to hold the throttle valve 3 at the predetermined intermediate opening degree position, is aligned in series with the application direction of the full close side engaging force F2, which is applied to the full close position stopper 34 from the full close side stopper portion 35 of the valve gear 26 at the time of driving the throttle valve 3 to the full close position. Furthermore, the protruding curved surface 40*c* is provided in the intermediate reaction force receiving portion 40*a* of the intermediate position stopper 40 to specify the point P1 of action of the intermediate reaction force F1. Also, the protruding curved surface (protrusion having the curved surface, preferably the semispherical surface) 35*a* is provided in the full close side stopper portion 35 of the valve gear 26 that is adapted to be engaged with the planar engaging surface of the full close side engaging force receiving portion 34*a* of the full close position stopper 34 to specify the point P2 of action of the full close side engaging force F2.

Figure 5A:
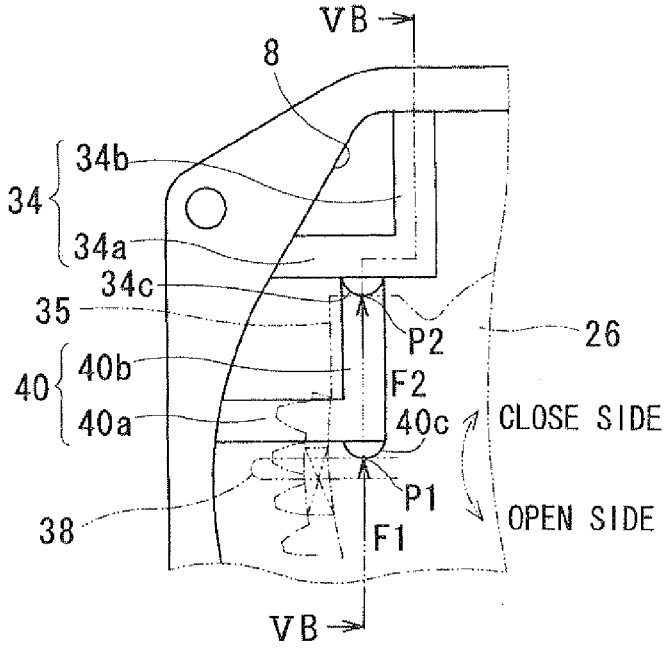
FIG. 5A is a partial enlarged view similar to FIG. 3A showing a modification of the embodiment.
Figure 5B:
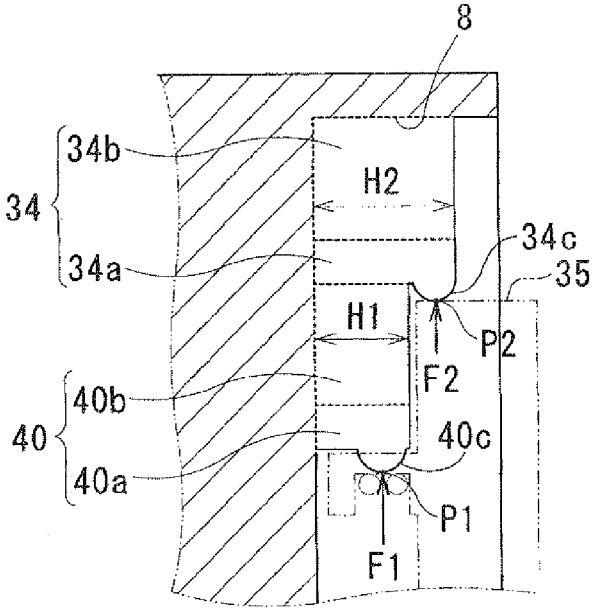
FIG. 5B is a cross-sectional view taken along line VB-VB in FIG. 5A.
Figure 6:
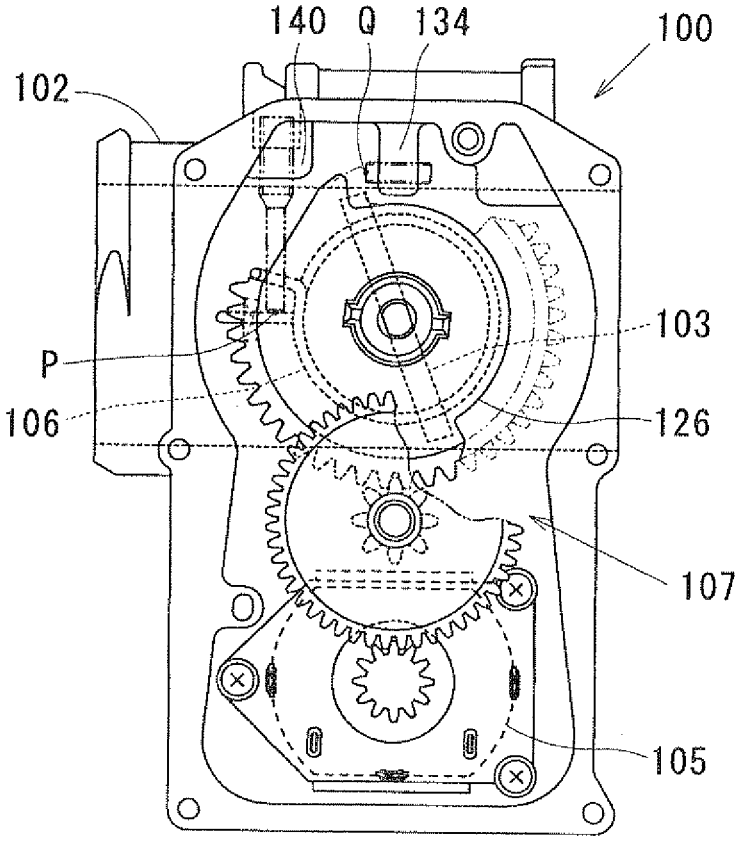
FIG. 6 PRIOR ART
FIG. 6 is a side view showing a gear case of a prior art throttle apparatus.

Alternatively, with reference to FIGS. 5A and 5B, in a modification of the above embodiment, a protruding curved surface (a protrusion having a curved surface, preferably a semispherical surface) 34*c* is provided in the full close side engaging force receiving portion 34*a* of the full close position stopper 34, and the contact surface of the full close side stopper portion 35, to which the protruding curved surface 34*c* contacts, is made as a planar surface or a protruding curved surface.

As shown in FIGS. 5A and 5B, similar to the above embodiment, the protruding curved surface (the protrusion having the curved surface, preferably the semispherical surface) 40*c* is provided in the intermediate reaction force receiving portion 40*a* of the intermediate position stopper 40 to protrude in the direction, which is perpendicular to the intermediate reaction force receiving portion 40*a* and is generally parallel to the application direction of the intermediate reaction force F1. Unlike the above embodiment, the protruding surface (the protrusion having the curved surface, preferably the semispherical surface) 34*c* is provided in the full close side engaging force receiving portion 34*a* of the full close position stopper 34 such that the center of the protruding curved surface 34*c* generally coincides with the central axis at generally the center part (center part in the left-to-right direction in FIG. 5A) of the full close side engaging force receiving portion 34*a*, to which the intermediate reaction force conducting portion 40*b* is connected, i.e., is joined.

In this way, the point P2 of action of the full close side engaging force F2 can be always aligned with the point P1 of action of the intermediate reaction force F1 Specifically, the point P2 of action and the point P1 of action can be generally coincided with the central axis of the intermediate reaction force conducting portion 40*b*, which extends through the left-to-right center of the intermediate reaction force conducting portion 40*b* in FIG. 5A. Therefore, the point P2 of action of the full close side engaging force F2 can be set at the center part of the full close side engaging force receiving portion 34*a*, which coincides with the central axis of the intermediate reaction force conducting portion 40*b* and at which the amount of deformation will be maximum in the full close side engaging force receiving portion 34*a*. In this way, even when the creep deformation is generated, it is possible to most effectively limit the deviation in the relative position between the point P1 of action of the intermediate reaction force and the point P2 of action of the full close side engaging force. Furthermore, even when the full close side engaging force receiving portion 34*a* is largely deformed, the protruding curved surface (protrusion having the curved surface, preferably the semispherical surface) 34*c* always enables to specify the point P2 of action of the full close side engaging force without causing the substantial deviation of the point P2 of action.

Furthermore, the configuration of the intermediate limiting member 40 and the configuration of the full close position limiting member 34 may be changed to any other configurations as long as the intermediate position limiting member 40 and the full close position limiting member 34 are adapted to be deformed through the creep deformation generally in the predetermined direction by the intermediate reaction force F1 applied from the return spring 6 while maintaining the substantially constant distance between the point P1 of action of the intermediate reaction force F1 at the intermediate position limiting member 40 and the point P2 of action of the full close side engaging force F2 at the full close position limiting member 34.

Additional advantages and modifications will readily occur to those skilled in the art. The invention in its broader terms is therefore not limited to the specific details, representative apparatus, and illustrative examples shown and described.

What is claimed is:

1. A throttle apparatus for an internal combustion engine, comprising:

a body that forms an intake passage, which is communicated with the internal combustion engine;

a valve that is rotatably received in the intake passage and is adapted to be driven to adjust an opening degree of the valve in the intake passage;

means for urging the valve toward a predetermined intermediate position between a full close position and a full open position of the valve from both of a full close position side and a full open position side of the valve;

an electric motor that is adapted to provide an output force upon energization thereof to drive the valve in a corresponding one of an opening direction and a closing direction of the valve against an urging force of the urging means;

a plurality of output force transmission members that cooperate together to conduct the output force of the electric motor to the valve;

a full close position limiting member that is adapted to be engaged with a predetermined one of the plurality of output force transmission members to limit further movement of the predetermined one of the plurality of output force transmission members when the valve is driven in the valve closing direction and reaches the full close position of the valve; and an intermediate position limiting member that is adapted to be engaged with the urging means when the valve is placed on a side of the predetermined intermediate position where the full close position of the valve is located, wherein:

the full close position limiting member receives a full close side engaging force from the predetermined one of the output force transmission members when the predetermined one of the output force transmission members is engaged with the full close position limiting member;

the intermediate position limiting member receives an intermediate reaction force from the urging means through the engagement with the urging means;

the full close side engaging force, which is applied to the full close position limiting member, and the intermediate reaction force, which is applied to the intermediate position limiting member, are generally directed in a predetermined direction;

the intermediate position limiting member is adapted to conduct the intermediate reaction force to the full close position limiting member, and the full close position limiting member is adapted to be deformed by the conducted intermediate reaction force generally in the predetermined direction; and a point of action of the full close side engaging force at the full close position limiting member is adapted to move generally in the predetermined direction upon the deformation of the full close position limiting member generally in the predetermined direction.

2. The throttle apparatus according to claim 1, wherein:

the intermediate position limiting member includes:

an intermediate reaction force receiving portion that receives the intermediate reaction force through the engagement with the urging means;

an intermediate reaction force conducting portion that conducts the intermediate reaction force from the intermediate reaction force receiving portion to the full close position limiting member;

the full close position limiting member, the intermediate reaction force receiving portion and the intermediate reaction force conducting portion are all configured into a plate form;

the intermediate reaction force receiving portion and a portion of the full close position limiting member are generally parallel to each other and are generally perpendicular to the predetermined direction;

the intermediate reaction force conducting portion is generally parallel to the predetermined direction and is generally perpendicular to the intermediate reaction force receiving portion and the portion of the full close position limiting member; and a plate thickness of the full close position limiting member, a plate thickness of the intermediate reaction force receiving portion and a plate thickness of the intermediate reaction force conducting portion are generally equal to each other.

3. The throttle apparatus according to claim 1, wherein the intermediate position limiting member has a protruding curved surface, on which a point of action of the intermediate reaction force is formed.

4. The throttle apparatus according to claim 1, wherein the full close position limiting member has a protruding curved surface, on which the point of action of the full close side engaging force is formed.

5. The throttle apparatus according to claim 1, wherein the intermediate position limiting member and the full close position limiting member are adapted to be deformed through creep deformation generally in the predetermined direction by the intermediate reaction force applied from the urging means while maintaining a substantially constant distance between a point of action of the intermediate reaction force at the intermediate position limiting member and the point of action of the full close side engaging force at the full close position limiting member.

6. The throttle apparatus according to claim 1, wherein:

the full close position limiting member includes:

a first planar portion that has a generally uniform thickness measured in a direction perpendicular to a plane of the first planar portion and includes a first end part joined to an inner peripheral wall surface of the body; and a second planar portion that has a generally uniform thickness measured in a direction perpendicular to a plane of the second planar portion and includes:

a first end part that is joined to the inner peripheral wall surface of the body; and a second end part that is joined to a second end part of the first planar portion to define a generally right angle between the first planar portion and the second planar portion; and the intermediate position limiting member includes:

a first planar portion that has a generally uniform thickness measured in a direction perpendicular to a plane of the first planar portion and is generally parallel to the first planar portion of the full close position limiting member, wherein the first planar portion of the intermediate position limiting member includes a first end part joined to the inner peripheral wall surface of the body; and a second planar portion that has a generally uniform thickness measured in a direction perpendicular to a plane of the second planar portion and is generally parallel to the second planar portion of the full close position limiting member, wherein the second planar portion of the intermediate position limiting member includes:

a first end part that is joined to a center part of the first planar portion of the full close position limiting member, which is centered between the first end part and the second end part of the first planar portion of the full close position limiting member; and a second end part that is joined to a second end part of the first planar portion of the intermediate position limiting member to define a generally right angle between the first planar portion and the second planar portion of the intermediate position limiting member.

7. The throttle apparatus according to claim 1, wherein the body, the full close position limiting member and the intermediate position limiting member are formed integrally from one of a metal material and a resin material.

8. The throttle apparatus according to claim 1, further comprising a shaft that is rotatably supported by the body, wherein:

the valve is fixed to the shaft to rotate integrally with the shaft;

the predetermined one of the plurality of output force transmission members is a valve gear, which is fixed to an end part of the shaft to rotate integrally with the shaft;

the urging means is a coil spring that is wound around the shaft and includes a first spring portion, which has one end part engaged with the body, and a second spring portion, which has one end part engaged with the valve gear, and the other end part of the first spring portion and the other end part of the second spring portion are joined together to form a U-shaped hook portion, which is adapted to be engaged with the intermediate position limiting member; and the first spring portion and the second spring portion are wound in opposite directions, respectively.

* * * * *